United States Patent [19]

Maeda

[11] 4,379,646

[45] Apr. 12, 1983

[54] PAPER FEED ROLL ROTATED BY PRINT HEAD CARRIER MOVEMENT

[75] Inventor: Katsutoshi Maeda, Tokyo, Japan

[73] Assignee: Kabushiki Kaisha Daini Seikosha, Japan

[21] Appl. No.: 133,144

[22] Filed: Mar. 24, 1980

[30] Foreign Application Priority Data

Mar. 26, 1979 [JP] Japan ..... 54-35378
Sep. 4, 1979 [JP] Japan ..... 54-122082[U]

[51] Int. Cl.[3] ..... B41J 13/02

[52] U.S. Cl. ..... 400/636; 400/120; 400/185; 400/317; 400/320; 400/570; 400/641

[58] Field of Search ..... 400/120, 185, 186, 187, 400/317, 320, 570, 571, 636, 641

[56] References Cited

U.S. PATENT DOCUMENTS

| | | | |
|---|---|---|---|
| 357,921 | 2/1887 | Hamilton | 400/636 |
| 1,116,212 | 11/1914 | Beard | 400/571 X |
| 3,628,645 | 12/1971 | McFeaters et al. | 400/317 X |
| 3,826,915 | 7/1974 | Giolitti et al. | 400/320 X |
| 4,046,246 | 9/1977 | Kondur, Jr. | 400/320 X |
| 4,062,436 | 12/1977 | Kondur, Jr. et al. | 400/185 X |

*Primary Examiner*—Ernest T. Wright, Jr.
*Attorney, Agent, or Firm*—Robert E. Burns; Emmanuel J. Lobato; Bruce L. Adams

[57] ABSTRACT

A thermal printer paper feeding mechanism having a reciprocable print head carrier. A paper feeding roller has a ratchet cross section with the ratchet teeth twisted along the length of the paper feed roller. The paper feed roller rotates for advancing paper to be printed on while the print head carrier returns to a start position after having printed a line.

7 Claims, 13 Drawing Figures

PAPER FEED ROLL ROTATED BY PRINT HEAD CARRIER MOVEMENT

BACKGROUND OF THE INVENTION

The present invention relates to a thermal printer and particularly to means for printing information on a thermal sensitive paper by a thermal printing head.

In the conventional paper feeding mechanism, various mechanisms are employed, such as, a mechanism in which rubber rollers for paper feeding are rotated by a motor, or a mechanism in which papers are griped in the forward motion by a lever reciprocally moving in the form of a circular arc and the paper is released therefrom in the reverse motion. However, there is a disadvantage in that the mechanisms of a speed reduction gear train or the intermittent feeding mechanisms are complicated, which enlarges the mechanism in size and increases the number of parts.

SUMMARY OF THE INVENTION

It is an object of the present invention to overcome the limitations of conventional printers. In accordance with the invention, a thermal printer has a simple mechanism, is small in size, inexpensive and and has few parts. Further a printing paper is fed out by a predetermined length by intermittently turning a paper feeding roller a predetermined degree angle of rotation by utilizing force due to the reciprocating motion of a printing head.

BRIEF DESCRIPTION OF THE DRAWING

The above mentioned and further objects, features and advantages of the present invention will be more fully understood from the following description in conjunction with the accompanying drawing which shows by way of example a preferred embodiment of the invention. In the drawing.

DESCRIPTION OF PREFERRED EMBODIMENT

Figure 1:
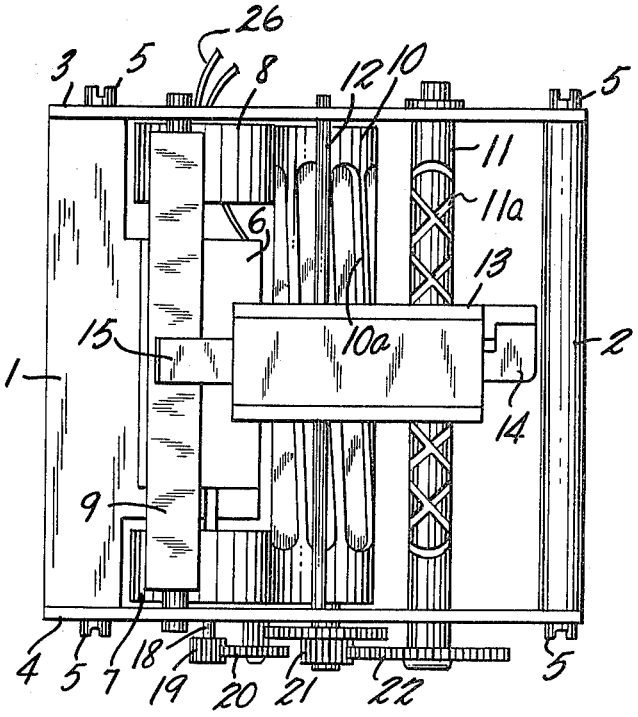
FIG. 1 is a plan view of an embodiment of the present invention.
Figure 2:
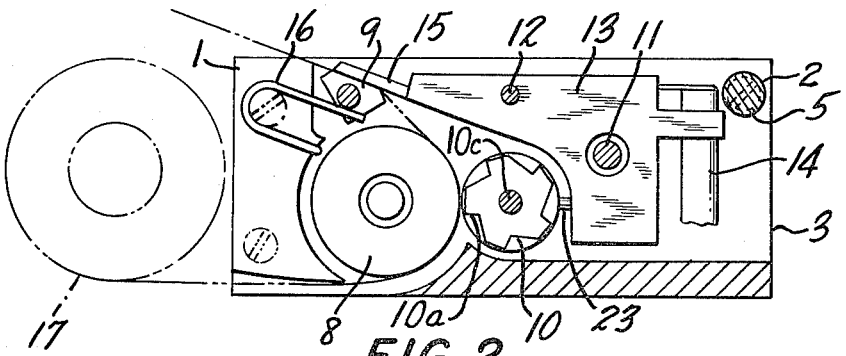
FIG. 2 is a side view of the embodiment of the present invention, wherein a plate member is removed.

In FIG. 1 and FIG. 2, a pair of plate members 3 and 4 are secured to a supporting frame 1 and a supporting rod 2 by screws 5 so as to hold them. A motor 6 is mounted on the supporting frame 1 and a pair of receiving rollers 7 and 8 is arranged at the both sides of the motor 6. The receiving rollers 7 and 8 are rotatably mounted on the plate members 4 and 3 respectively. A printing paper 17 is held between the receiving rollers 7 and 8 and a paper feeding roller 10 pressed against the receiving rollers 7 and 8, and the printing paper 17 is fed out when the paper feeding roller 10 is rotated in the clockwise direction in FIG. 2. The paper feeding roller 10 has a shaft 10C for mounting the paper feeding roller 10 for rotation.

Electrical conductors 26 for the motor 6 pass through the spindle 24 of the receiving roller 8. On the other hand, a motor shaft 18 is projected from the plate member 4 through a hollow portion in the spindle 25 of the receiving roller 7, and a motor gear 19 is rigidly mounted on the motor shaft 18. The torque of the motor 6 is transmitted to rotate a head feeding shaft or spindle 11 through speed reduction gears 20, 21 and 22 which are rotatably mounted on the plate member 4. A bidirectional cam groove 11*a* for the reciprocating motion of a head carrier 13 is defined in the head feeding shaft 11. A printing head 15 and a flexible base plate 14 are secured to the head carrier 13, and are reciprocated together with the head carrier 13 along a guide shaft 12 arranged in parallel to the head feeding spindle 11. The printing head 15 faces a platen 9 with the printing paper 17 between them, and the platen 9 is biased by an elastic member 16. A plurality of operating grooves 10*a* are defined at the outer-circumference portion of paper feeding roller 10, and the reciprocating motion of the head carrier 13 is converted into the intermittent rotating motion of paper feeding roller 10 by utilizing a projected portion 23 which is projected from the head carrier 13.

The present invention relates to a mechanism which converts the reciprocating motion of the print head carrier 13 to rotation of the paper feeding roller 10, and in connection with this point a description of the invention will be made in more detail.

Figure 3:
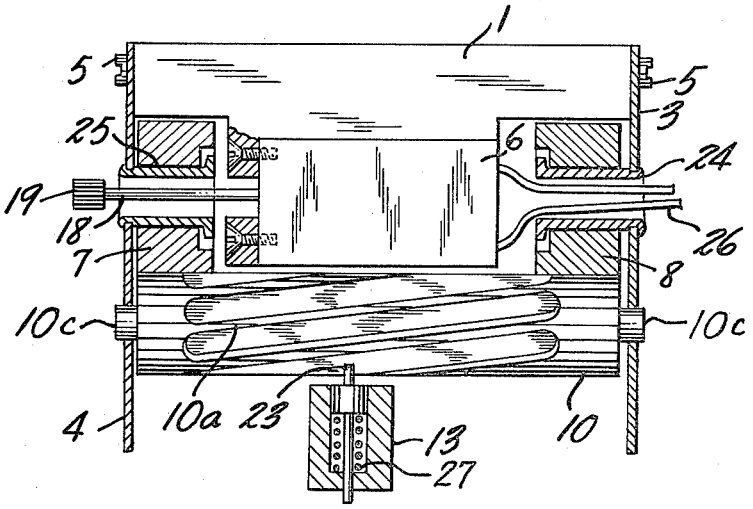
FIG. 3 is a plan view for illustrating an important portion of an embodiment of the present invention.
Figure 4A:
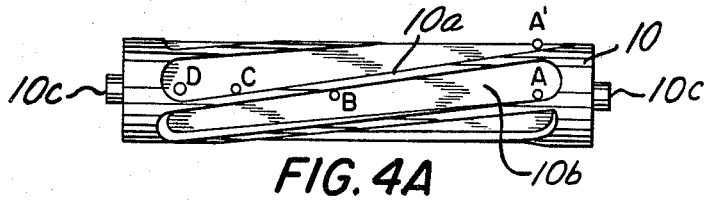
FIGS. 4A and 4B are illustrative views of a paper feeding roller for showing the operation of a first embodiment of the present invention.
Figure 4B:
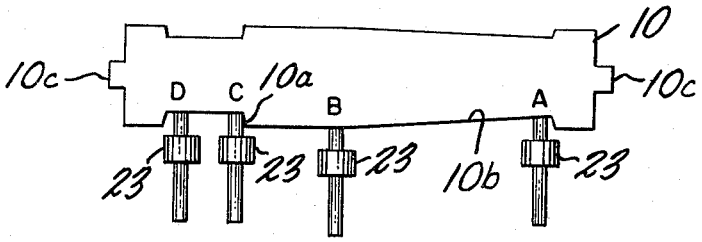
Figure 10:
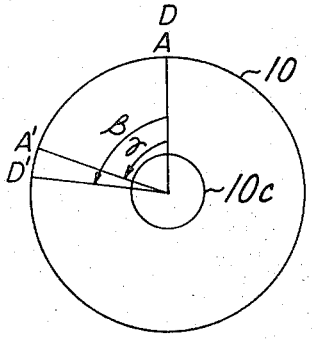
FIG. 10 is an end view of the paper feeding roller shown in FIGS. 4A and 4B, showing the relation between the angular spacing of operating groove segments of the paper feeding roller and the angle of twist of the paper feeding roller operating groove.

In FIG. 3, the relationship between the paper feeding roller 10 and the head carrier 13 of one example of the present invention is illustrated. The operating grooves 10*a* of the paper feeding roller 10 are defined in the form of a ratchet in the sectional figure of the paper feeding roller 10, and the wall portion of the operating groove 10*a* is given a predetermined tilt from an axis of rotation of the paper feeding roller 10. In this embodiment, there are six operating grooves 10*a* spaced at angular intervals $\alpha$ of 60° and the respective operating grooves 10*a* are twisted through an angle $\beta=70°$ between one end of the operating groove 10*a* and the other end of the operating groove 10*a*. The relationship between the angular separation $\alpha$ of the operating grooves 10*a* and the angle of twist $\beta$ of the operating grooves 10*a* is shown in FIG. 10 which is an end view of the paper feeding roller 10 shown in FIGS. 4A and 4B. The angular position of the points A and D shown in FIG. 4A is indicated in FIG. 10. Point A′ is the position corresponding to point A in the next adjacent operating groove 10*a* and is displaced relative to point A by the angular separation $\alpha$ between the operating grooves 10*a* of the paper feeding roller 10. The point D′ is the position of the point D displaced along the length of the operating groove 10*a* in which it lies to its opposite end, which results in the respective angular positions of the points D and D′ being displaced by the angle of twist $\beta$. As described above, when the angle of twist $\beta$ in the operating groove 10*a* is larger than the angular spacing $\alpha$ between the operating grooves 10*a*, the projected portion 23 mounted on the one end portion of the head carrier 13 can reliably change from one operating groove 10*a* to the next operating groove 10*a* by the movement of the projected portion 23 mounted on one end portion of the head carrier 13 and biased gently by the elastic member 27. That is, in FIGS. 4A and 4B, if the start point of the projected portion 23 is a point A, when the printing head 15 is moved in the left direction, the projected portion 23 is moved together with the printing head 15 to move in the left direction.

When the projected portion 23 is moved from the point A to the point B, the projected portion 23 goes up a slope 10*b* formed in the form of a taper, and the portion 23 is changed to the next operating groove 10*a* when it reaches a point C. The projected portion 23 starts to move in the right direction after it reaches a point D. The projected portion 23 returns along the same path as the path of advancement before it reaches the point C, however, the projected portion 23 comes in contact with the wall of the operating groove 10*a* at the point C to advance in the right direction while pressing the wall of the operating groove 10*a*. Then the projected portion 23 reaches a point A'. In the actual operation, since the projected portion 23 goes back and forth between the point D and the point A, it follows that the paper feeding roller 10 is rotated until the point A' is coincident with the point A. At this time, if the angle of twist $\beta$ of the operating groove 10*a* is less than the angular separation $\alpha$ of the operating grooves 10*a*, the projected portion 23 can not change to the next operating groove 10*a*, and if the angle of twist $\beta$ of the operating groove 10*a* is larger than twice the angular separation $\alpha$ of the operating grooves 10*a*, the projected portion 23 changes position to a second successive one of the operating grooves 10*a*. Therefore, the angle of twist $\beta$ of the operating groove 10*a* should be larger than that of the angular separation $\alpha$ thereof and less than twice the angular separation $\alpha$ thereof. If the above mentioned condition is satisfied, the rotational angle of the paper feeding roller 10 for each increment of rotation is limited to the angular separation $\alpha$ of the operating groove 10*a* irrespective of the twist angle $\beta$. In addition, it is possible that the number of operating grooves 10*a* can be equal to any integer greater than three.

Figure 5A:
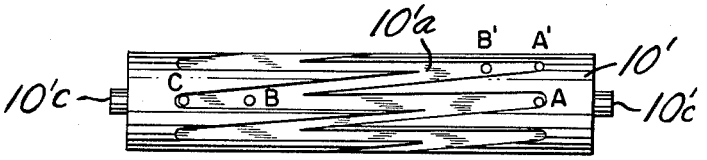
FIGS. 5A and 5B are illustrative views for showing the operation of a second embodiment of the present invention.
Figure 5B:
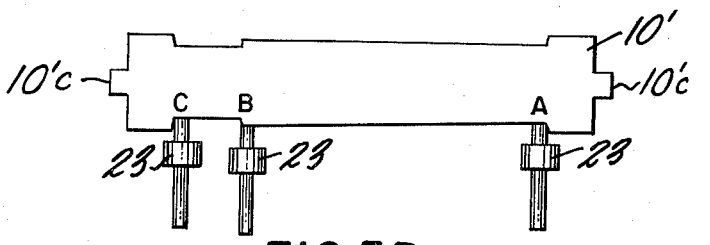

FIGS 5A and 5B illustrate a second embodiment of the present invention. An operating groove 10'*a* is defined in the form of a zigzag on the outer circumference portion of paper feeding roller 10'. A first operating groove 10'*a* is parallel to a shaft 10'*c* of the paper feeding roller 10', and a second operating groove 10'*a* and the shaft 10'*c* of the paper feeding roller 10' together make an angle of a predetermined degree. The first operating groove 10'*a* is continuously defined in the form of a taper from the right to the left, and the second operating groove 10'*a* is continuously defined in the form of a taper from the left to the right. The projected portion 23 mounted on the one end portion of the head carrier 13, is engaged with this operating groove 10'*a* and is moved along the first groove 10'*a* when it moves from the right to the left. The portion 23 goes up a slope formed in the form of a taper from the deep portion at the point A to the point B, and it falls into the deep portion of the second groove 10'*a* at the point C.

The projected portion 23 moves along the second groove 10'*a* from the point C when moving from the left to the right, and the projected portion 23 goes up a slope formed in the form of a taper from the deep portion to the shallow portion between the points C and B'. Then the projected portion 23 falls into the deep portion of the first groove 10'*a*. In the actual operation, since the projected portion 23 goes back and forth between the points A and C, it follows that the paper feeding roller 10' is rotated until the point A' is coincident with the point A.

According to the above described mechanism, the reciprocating motion of the printing head 15 can be easily converted into the rotating motion of the paper feeding roller 10, and moreover, improper operation in which paper 17 is returned is prevented since the paper feeding roller 10 always rotates in the same direction as that of the paper feeding. Consequently the paper 17 can be exactly fed in feeding length every time. Due to the reduction of the number of parts, it is possible to obtain a smaller printer, and furthermore, it is useful for cost reduction and an improvement of reliability.

Referring now to the second embodiment illustrated in the drawing in which

Figure 6A:
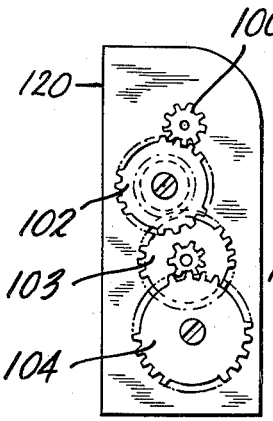
FIGS. 6A and 6B are a side view and a front view of a printer of the present invention respectively.
Figure 6B:
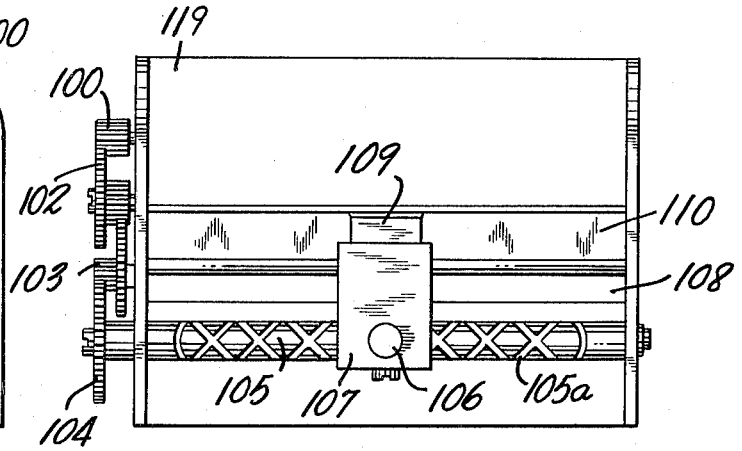

FIG. 6(A) is a side view thereof, a speed reduction gear train is constructed by the use of a motor gear 100, two intermediate gears 102 and 103 and a head feeding screw wheel 104. FIG. 6(B) is a plan view, and a head feeding screw 105 is rotated together with the head feeding screw wheel 104. A bidirectional cam groove 105*a* is defined in the head feeding screw 105, and a tip portion of a head feeding pin 106 is engaged with the cam groove 105*a*. The head feeding pin 106 loosely penetrates into a head carrier 107 which is arranged so as to slidably move in the axis direction of the head feeding screw 105. As a result, the head carrier 107 can be reciprocally moved in accordance with the rotation of the head feeding screw 105.

Figure 7:
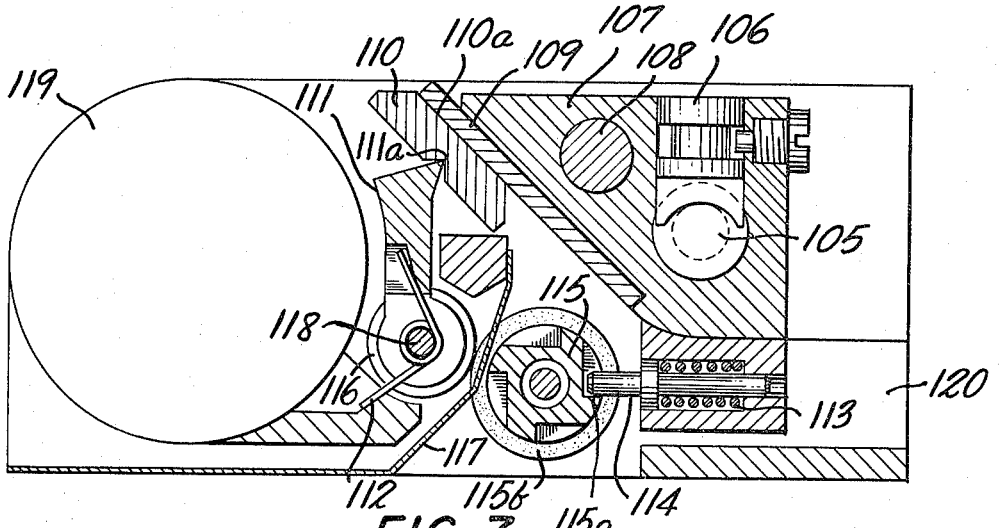
FIG. 7 is a sectional view of a printer of the present invention.
Figure 8:
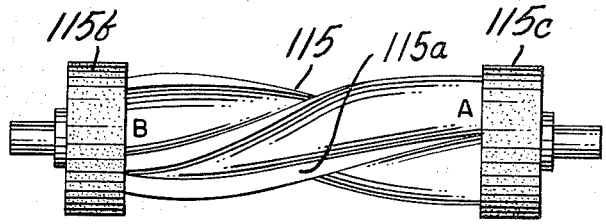
FIG. 8 is a flat plan view of a paper feeding roller of the present invention.

FIG. 7 is a central sectional view of FIG. 6B, and a guide shaft 108 is arranged in parallel to the head feeding screw 105 in order that the head feeding screw 105, the head feeding pin 106 and the head carrier 107 can smoothly move in the axial direction of the head feeding screw 105. A print head 109 is secured to the head carrier 107 by the use of an adhesive or the like, and a biasing force is applied to a platen bed 111 by an elastic member 112 so as to keep the head 109 in tight contact with an upper surface 110*a* of the platen 110. The platen 110 is supported at a knife edge portion 111*a* of the platen bed 111, and the print head 109 is arranged in parallel to the upper surface 110*a* of the platen 110 and is arranged so as to tightly contact therewith. Under the head carrier 107, an elastic member 113 and a projected member 114 is arranged, and the projected member 114 is engaged with a ratchet portion 115*a* of a paper feeding roller 115. Further the ratchet portion 115*a* is twisted in the direction from one end thereof to the other end thereof as illustrated in FIG. 8, so that the projected member 114 is not engaged with the ratchet portion 115*a* when the projected member 114 moves from a point A in FIG. 8 to a point B.

As a result, the paper feeding roller 115 is not related. On the other hand, the projected member 114 is engaged with the ratchet portion 115*a* when it moves from the point B to the point A, so that the paper feeding roller 115 is rotated. There are provided rubber rollers 115*b* and 115*c* at each end of the paper feeding roller 115, and they each face a respective one of the receiving rollers 116.

In the present invention, these receiving rollers 116 and the platen bed 111 are supported by a loosely penetrating shaft 118.

Figure 9:
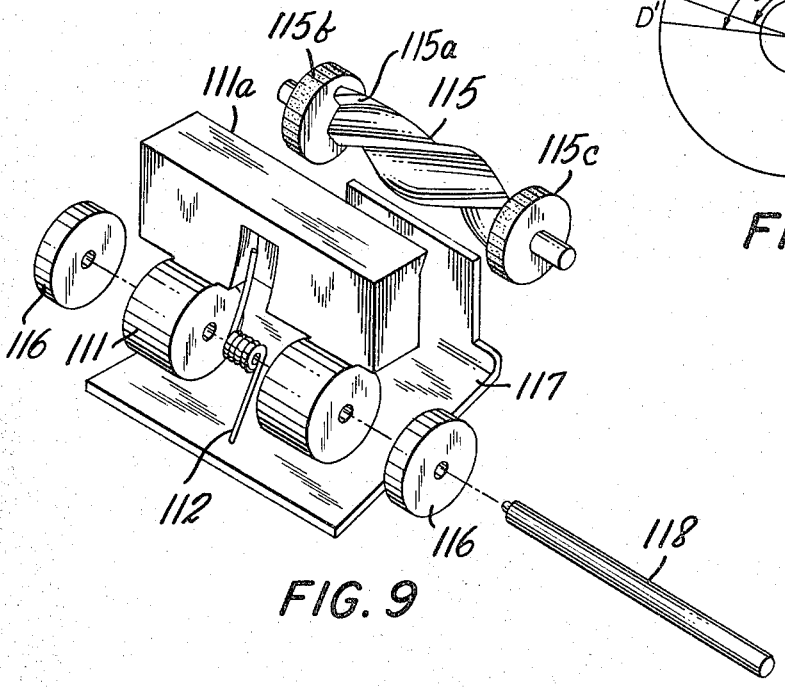
FIG. 9 is an exploded perspective view of major parts of the present invention.

The diameters of the rollers 115*b* and 115*c* are larger than that of the ratchet portion 115*a* of the paper feeding roller 115 and a paper pressing member 117 is arranged in a space produced by the difference between the diameters. The paper pressing member 117 is a plate-like member defining a guide surface for guiding the paper to advance between the paper feeding roller 115 and the paper receiving rollers 116. As a result, a zigzag feeding or a rising-up in the paper feeding operation is prevented. The major parts of this embodiment are shown in FIG. 9. The above-described parts designated by the reference numerals 101 to 118 and the motor 119 can be mounted on a frame 120, and the printer is accomplished.

As described above, according to the present invention, a printer consisting of only about twenty parts can be obtained, and a printer which is small in size and inexpensive can be easily obtained. Moreover the number of parts is small and the reliability of the printer becomes higher.

What is claimed is:

1. A printer comprising: a platen; a print head positioned opposite said platen; a print head driving shaft having a bidirectional cam-groove and oriented parallel to said platen; means on said print head for engaging said bidirectional cam-groove to effectuate reciprocating movement of said print head parallel to said platen in response to rotation of said driving shaft; and paper feeding and positioning means for feeding paper between said print head and said platen and for positioning the paper to be printed on, said paper feeding and positioning means comprising a paper feeding roller having a middle portion and a pair of end portions, said print head and said paper feeding roller middle portion together comprising means for rotating said paper feeding roller through a predetermined angular interval each time said print head travels from one end of said platen to another in one particular direction, a pair of paper receiving rollers each disposed opposite a respective one of said paper feeding roller end portions, said paper receiving rollers and corresponding ones of said paper feeding roller end portions receiving therebetween, in use, paper to be printed on and which is advanced up to said platen by rotation of said paper feeding roller with the paper gripped between said paper feeding roller end portions and said paper receiving rollers, wherein said paper feeding roller end portions have respective diameters larger than a diameter of said paper feeding roller middle portion, and means comprising a guide surface for guiding paper to advance between said paper feeding roller and said paper receiving rollers, wherein said means comprising a guide surface is comprised of a plate-like member disposed between said paper feeding roller end portions opposite said paper feeding roller middle portion and spaced from said paper feeding roller middle portion a distance less than the difference between the radius of said paper feeding roller middle portion and said paper feeding roller end portions.

2. A printer according to claim 1, further comprising a mounting shaft mounting said pair of paper receiving rollers for rotation about a common axis of rotation defined by a longitudinal dimension of said mounting shaft; a block defining a platen bed for supporting said platen at a position facing said print head, said block including means for mounting said platen bed on said mounting shaft to permit said platen bed to pivot toward and away from said print head about the axis of rotation of said paper receiving rollers; and means for resiliently biasing said block defining said platen bed toward said print head for maintaining said platen abutting said print head.

3. A printer according to claim 1, wherein said means for rotating said paper feeding roller through a predetermined angular interval is comprised of a pin mounted on said print head; mounting means for mounting said pin on said print head oriented to contact and travel along said paper feeding roller middle portion and for mounting said pin for axial travel toward and away from said paper feeding roller middle portion; pin biasing means for resiliently biasing said pin toward said paper feeding roller middle portion; and surface grooves formed in said paper feeding roller middle portion for receiving said pin mounted on said print head as said print head travels transversely of said paper feeding roller and configured to permit said print head to travel the length of said platen in said one particular direction without said pin interfering with said paper feeding roller grooves and configured to cause said pin to interfere with said paper feeding roller grooves as said print head travels the length of said platen in the opposite direction and rotate said paper feeding roller through a predetermined angular interval.

4. A printer according to claim 3, wherein said paper feeding roller middle portion has formed therein a family of surface grooves regularly spaced circumferentially of said paper feeding roller and extending generally in the length direction of said upper paper feeding roller and at an angle to the longitudinal axis of said paper feeding roller so that opposite ends of the respective grooves are circumferentially spaced around said paper feeding roller, and the surface grooves have a profile effective to permit said pin mounted on said print head to travel in a straight path along said paper feeding roller without interfering with said paper feeding roller as said print head travels in said one particular direction and to interfere with said paper feeding roller as said print head travels in said other direction so as to cause said paper feeding roller to rotate angularly through an interval determined by the angular spacing of the respective surface grooves on said paper feeding roller to advance paper to be printed on to said platen.

5. A printer according to claim 5, wherein said paper feeding roller has surface grooves configured such that a cross section of said paper feeding roller is in the shape of a ratchet wheel.

6. A printer comprising: a platen; a print head positioned opposite said platen; a print head driving shaft having a bidirectional cam-groove and oriented parallel to said platen; means on said print head for engaging said bidirectional cam-groove to effectuate reciprocating movement of said print head parallel to said platen in response to rotation of said driving shaft; and paper feeding and positioning means for feeding paper between said print head and said platen and for positioning the paper to be printed on, said paper feeding and positioning means comprising a paper feeding roller having a middle portion and a pair of end portions, said print head and said paper feeding roller middle portion together comprising means for rotating said paper feeding roller through a predetermined angular interval each time said print head travels from one end of said platen to another in one particular direction, a pair of paper receiving rollers each disposed opposite a respective one of said paper feeding roller end portions, said paper receiving rollers and corresponding ones of said paper feeding roller end portions receiving therebetween, in use, paper to be printed on and which is advanced up to said platen by rotation of said paper feeding roller with the paper gripped between said paper feeding roller end portions and said paper receiving rollers, a mounting shaft mounting said pair of paper receiving rollers for rotation about a common axis of rotation defined by a longitudinal dimension of said mounting shaft, and means comprising a guide surface for guiding paper to advance between said paper feeding roller and said paper receiving rollers; a block defining a platen bed for supporting said platen at a position facing said print head, said block including means for mounting said platen bed on said mounting shaft to permit said platen bed to pivot toward and away from said print head about the axis of rotation of said paper receiving rollers; and means for resiliently biasing said block defining said platen bed toward said print head for maintaining said platen abutting said print head.

7. A printer comprising: a platen; a print head positioned opposite said platen; a print head driving shaft having a bidirectional cam-groove and oriented parallel to said platen; means on said print head for engaging said bidirectional cam-groove to effectuate reciprocating movement of said print head parallel to said platen in response to rotation of said driving shaft; and paper feeding and positioning means for feeding paper between said print head and said platen and for positioning the paper to be printed on, said paper feeding and positioning means comprising a paper feeding roller having a middle portion and a pair of end portions, a pin mounted on said print head, mounting means for mounting said pin on said print head oriented to contact and travel along said paper feeding roller middle portion and for mounting said pin for axial travel toward and away from said paper feeding roller middle portion, pin biasing means for resiliently biasing said pin toward said paper feeding roller middle portion, surface grooves formed in said paper feeding roller middle portion for receiving said pin mounted on said print head as said print head travels transversely of said paper feeding roller and configured to permit said print head to travel the length of said platen in said one particular direction without said pin interfering with said paper feeding roller grooves and configured to cause said pin to interfere with said paper feeding roller grooves as said print head travels the length of said platen in the opposite direction and rotate said paper feeding roller through a predetermined angular interval, the surface grooves formed in said paper feeding roller middle portion comprising a family of surface grooves regularly spaced circumferentially of said paper feeding roller and extending generally in the length direction of said paper feeding roller and at an angle to the longitudinal axis of said paper feeding roller so that opposite ends of the respective grooves are circumferentially spaced around said paper feeding roller and said paper feeding roller having a cross section in the shape of a ratchet wheel, a pair of paper receiving rollers each disposed opposite a respective one of said paper feeding roller end portions, said paper receiving rollers and corresponding ones of said paper feeding roller end portions receiving therebetween, in use, paper to be printed on and which is advanced up to said platen by rotation of said paper feeding roller with the paper gripped between said paper feeding roller end portions and said paper receiving rollers, said paper feeding roller end portions having respective diameters larger than a diameter of said paper feeding roller middle portion, a mounting shaft mounting said pair of paper receiving rollers for rotation about a common axis of rotation defined by a longitudinal dimension of said mounting shaft, means comprising a guide surface for guiding paper to advance between said paper feeding roller and said paper receiving rollers; wherein said means comprising a guide surface is comprised of a plate-like member disposed between said paper feeding roller end portions opposite said paper feeding roller middle portion and spaced from said paper feeding roller middle portion a distance less than the difference between the radius of said paper feeding roller middle portion and said paper feeding roller end portions; a block defining a platen bed for supporting said platen at a position facing said print head, said block including means for mounting said platen bed on said mounting shaft to permit said platen bed to pivot toward and away from said print head about the axis of rotation of said paper receiving rollers; and means for resiliently biasing said block defining said platen bed toward said print head for maintaining said platen abutting said print head.

* * * * *